US012649500B2

(12) United States Patent
Mitchell

(10) Patent No.: US 12,649,500 B2
(45) Date of Patent: Jun. 9, 2026

(54) HIGH SPEED SUSPENDED TRANSIT SYSTEM AND RELATED METHODS

(71) Applicant: Mark Mitchell, Lakeport, CA (US)

(72) Inventor: Mark Mitchell, Lakeport, CA (US)

( * ) Notice: Subject to any disclaimer, the term of this patent is extended or adjusted under 35 U.S.C. 154(b) by 488 days.

(21) Appl. No.: 18/199,593

(22) Filed: May 19, 2023

(65) Prior Publication Data

US 2024/0017751 A1 Jan. 18, 2024

Related U.S. Application Data

(60) Provisional application No. 63/388,483, filed on Jul. 12, 2022.

(51) Int. Cl.
*B61B 13/04* (2006.01)
*B61B 13/08* (2006.01)

(52) U.S. Cl.
CPC ..... *B61B 13/04* (2013.01); *B61B 13/08* (2013.01)

(58) Field of Classification Search
CPC .. B61B 3/00; B61B 3/02; B61B 13/04; B61B 13/08
See application file for complete search history.

(56) References Cited

U.S. PATENT DOCUMENTS

2012/0055367 A1* 3/2012 Zayas ..... B61B 3/00 104/88.01

* cited by examiner

*Primary Examiner* — Robert J McCarry, Jr.

(57) ABSTRACT

The invention disclosed is a high-speed suspended monorail transport system, characterized by an elevated rail system with a circular rail flange profile, aerodynamic passenger or cargo cars, a computer control system, and electric hub motors. The system utilizes a unique bogie-like wheel assembly that allows the wheels to roll along different areas of the circular rail flange, accommodating bends and curves at varying speeds without the need for conventional suspension systems. The invention also includes an associated computer process for controlling system functions. The transport system offers significant improvements in privacy, comfort, speed, and cost-effectiveness compared to existing solutions. An alternate embodiment and several optional features for enhanced functionality are also disclosed.

15 Claims, 14 Drawing Sheets

HIGH SPEED SUSPENDED TRANSIT SYSTEM AND RELATED METHODS

CROSS REFERENCE TO RELATED APPLICATIONS

This patent application claims the benefit of U.S. provisional Application No. 63/388,483, filed 12 Jul. 2022.

FIELD OF INVENTION

The present invention relates generally to transportation systems, and more specifically to a suspended monorail system for high-speed transport of passengers and cargo. The system leverages a unique design of a circular flange profile rail with a bogie-like wheel assembly to enable efficient navigation of the monorail car around curves at high speed.

BACKGROUND

With the increasing pace of urbanization and globalization, the demand for rapid and efficient transportation systems has never been higher. Traditional solutions such as trains and airplanes have been the most relied upon modes of high-speed travel. However, these systems present a number of drawbacks and limitations.

High-speed rail systems, while capable of transporting large numbers of passengers at considerable speeds, are often hindered by frequent stops at stations along their routes to load and unload passengers and goods. This interruption significantly prolongs travel time, making the experience less convenient for those traveling longer distances.

Airplanes, on the other hand, offer the benefit of direct routes but are plagued with inconveniences at the airports at both ends of the journey, including security checks, delays, and large crowds. Further, the lack of privacy and comfort in overcrowded airplanes often contributes to a less than satisfactory travel experience.

In light of these drawbacks, other transportation solutions have been proposed, including various designs for suspended monorail systems. However, these systems have been unable to gain traction due to issues such as high construction costs and unproven technology. Furthermore, these systems often fail to meet the requirements of high-speed travel, particularly when it comes to navigating bends and curves in the rail at high speed.

Existing suspended monorail systems often employ a track design that must be bent or shaped to accommodate curves. If the monorail car does not match the speed for which the curved rail was designed, the system fails to operate as intended. This imposes speed limitations on the monorail car and increases wear and tear on the system components, leading to higher maintenance costs.

While some prior art suspended monorail systems have utilized bogie-like wheel assemblies and others have suggested the use of radially arranged wheels to mitigate the wear on components caused by traversing curved rail sections, none have proposed the incorporation of a rail flange with a circular profile to address this problem.

Given the drawbacks and limitations of existing transportation systems, there exists a need for a new kind of transportation system that is not only fast and efficient but also provides a comfortable and private travel experience. Ideally, such a system would offer non-stop travel between two points, reducing the overall travel time. Furthermore, the construction costs of such a system should be substantially lower than those of conventional systems, making it economically viable.

It is within this context that the present invention is provided.

SUMMARY

The present invention seeks to meet these needs by introducing a novel suspended monorail transportation system that employs a unique design featuring a circular flange profile rail and a bogie-like wheel assembly. This system is designed to allow the monorail car to navigate curves at high speed without the need for mechanical assistance or a change in rail profile, thereby improving the efficiency, speed, and reliability of the system.

The present invention provides an innovative high-speed transport system that leverages a suspended monorail configuration, offering significant improvements in terms of privacy, comfort, convenience, and cost-effectiveness.

The disclosed system primarily comprises an elevated rail system, aerodynamic passenger or cargo cars, a computer control system, and electric hub motors. The rail system is uniquely structured with a circular rail flange, and the cars are suspended from the rails via bogie-like wheel assemblies.

The wheel assemblies are configured such that the wheels roll along different areas of the circular rail flange while remaining perpendicular to the rolling axis and the central axis of the rail, thereby accommodating forces during bends and curves. This design eradicates the need for conventional suspension systems and allows for a smoother ride at varying speeds.

The invention also encompasses an associated computer process for monitoring and controlling system functions, including acceleration, braking, climate control, emergency procedures, passenger loading and unloading, schedule arrival and departure times, and maintenance schedules An alternate embodiment of the invention involves a continuous hollow electrical conductor placed inside an open bottom flange of the rail, which provides electrical contact for the whole system.

Optional features to be developed further include detachable cars for cargo transport, private cars with reduced seating capacity for enhanced privacy, and vertically stacked rail pairs for increased capacity.

In effect, this invention resolves many of the challenges associated with existing high-speed transport solutions, offering a highly efficient, cost-effective, and pleasurable travel experience.

BRIEF DESCRIPTION OF THE DRAWINGS

Various embodiments of the invention are disclosed in the following detailed description and accompanying drawings.

Figure 1:
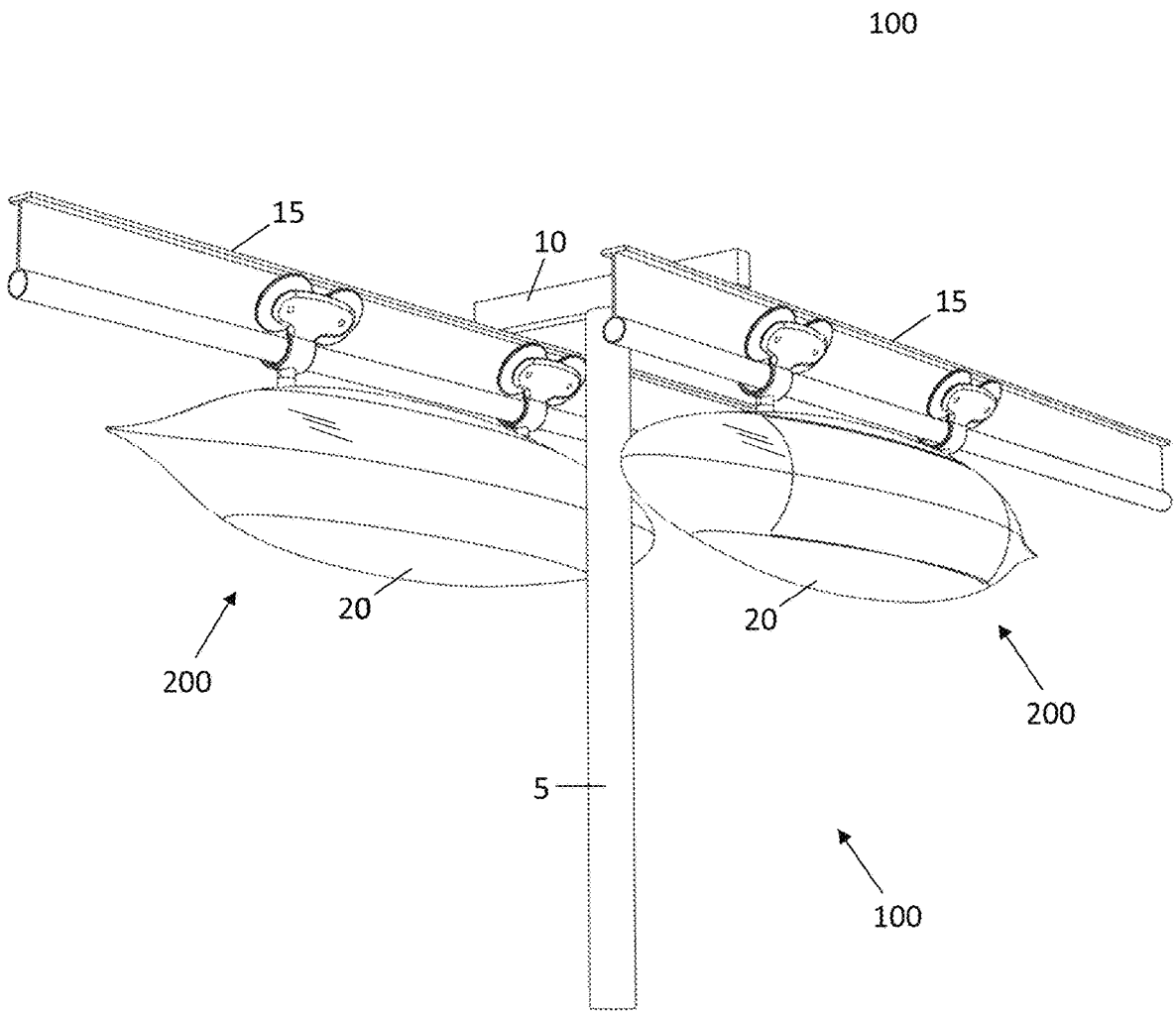
FIG. 1 is a perspective view of the major components of an elevated transit system, demonstrating the vertical support tower, horizontal support, rails, and car with its body and bogies.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

Definitions

The terminology used herein is for the purpose of describing particular embodiments only and is not intended to be limiting of the invention.

As used herein, the term "and/or" includes any combinations of one or more of the associated listed items.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The terminology used herein is for the purpose of describing particular embodiments only and is not intended to be limiting. As used herein, the singular forms "a," "an" and "the" are intended to include the plural forms as well, unless the context clearly indicates otherwise.

The terms "first," "second," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

FIG. 1 illustrates a perspective view of a single section of the elevated transit system (100). The elevated transit system comprises a vertical support tower (5), rigidly connected to the ground, topped with a horizontal support (10). Rails (15) are suspended from the horizontal support at each end, creating a continuous linear arrangement. A car (200), comprising the body (20), and bogies (30), is suspended from the rail. The car can be oriented in either direction, allowing for two-way traffic on parallel rails.

Figure 2:
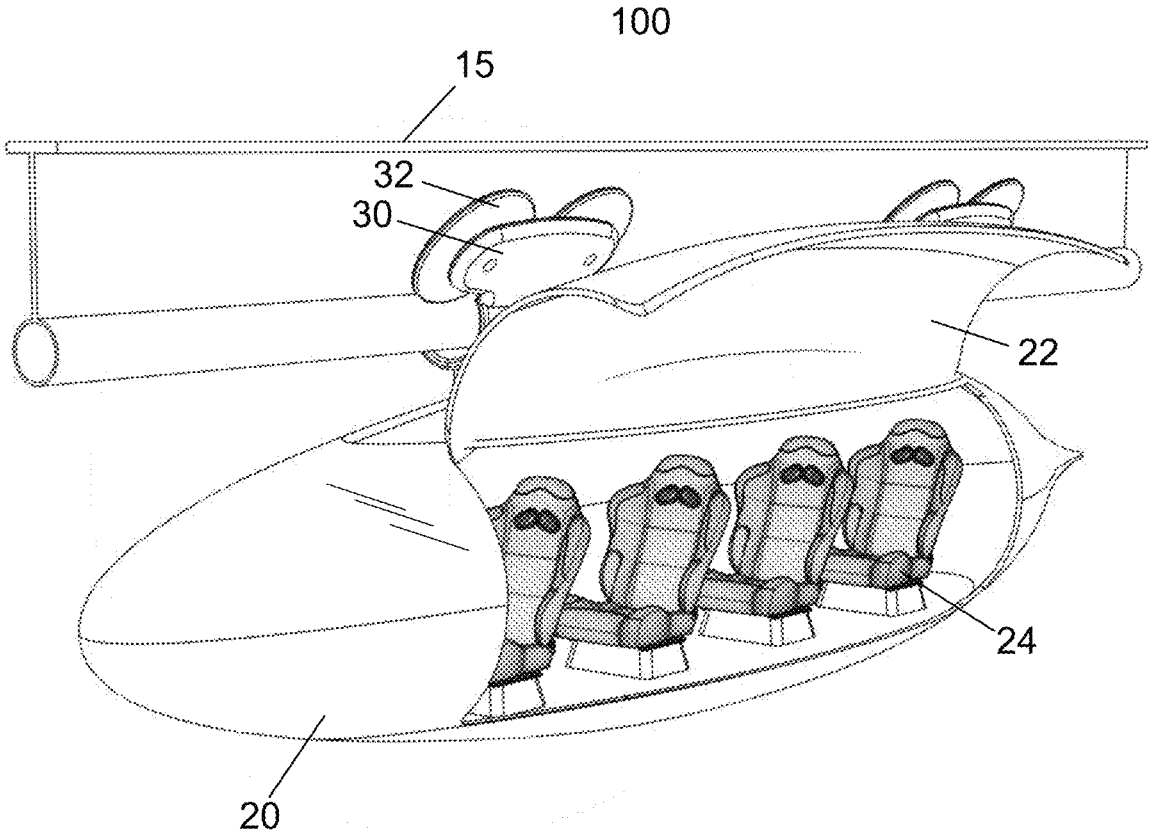
FIG. 2 is a front left perspective view of the car body mounted on a rail, illustrating the passenger seats and the front bogie with its wheels.

FIG. 2 presents a perspective view of the car body (20) suspended from one of the rails (15). An open door (22) is visible, showing the interior passenger seats (24). The car (200) is mounted on a set of bogies (30), each with two wheels (32) rolling on the bottom circular flange of the rail (15).

Figure 3:
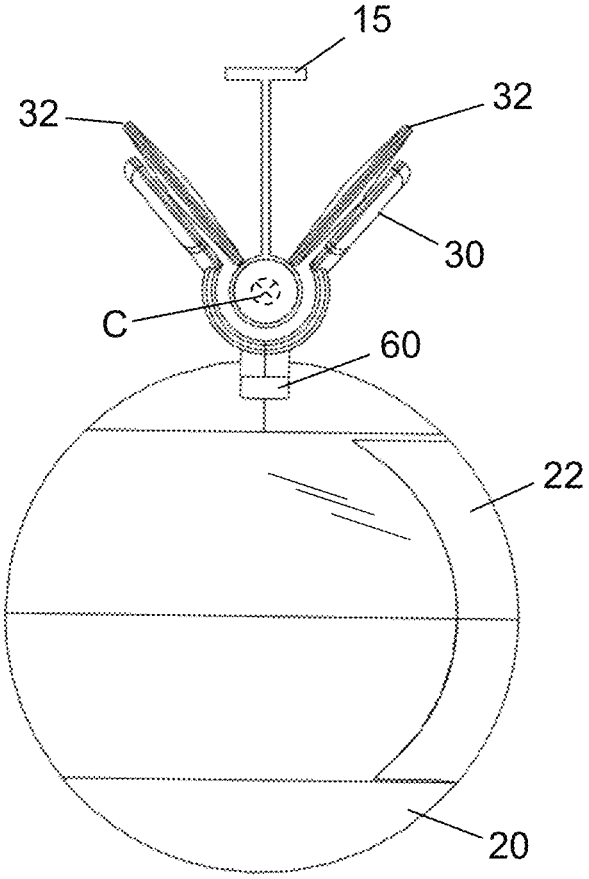
FIG. 3 is a front view of the car body, detailing the attachment of each bogie to the top of the car body via a mechanical pivot and the inclination of the wheels to align with the center of rotation of the bogie and the rail.

FIG. 3 demonstrates a front view of the car body (20) with the door (22) closed. The car body (20) is attached to the bogies (30) via a mechanical pivot (60). The wheels (32) are inclined at an angle such that their longitudinal axis is coincident with the radial center of the circular rail (15).

Figure 4:
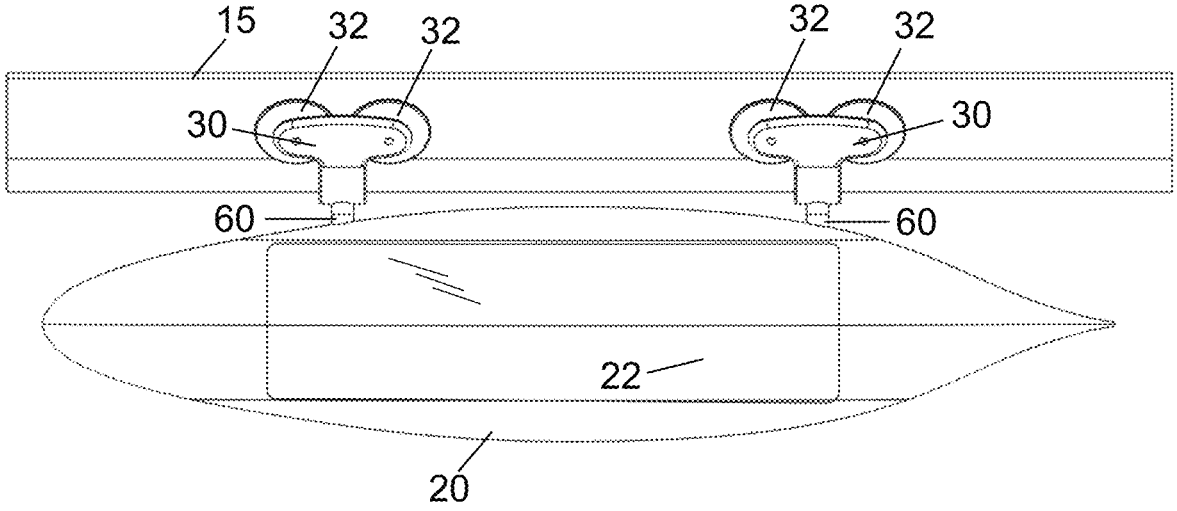
FIG. 4 provides a left-side view of the car body suspended beneath the rail, indicating the attachment of each bogie to the body via a pivot.
Figure 5:
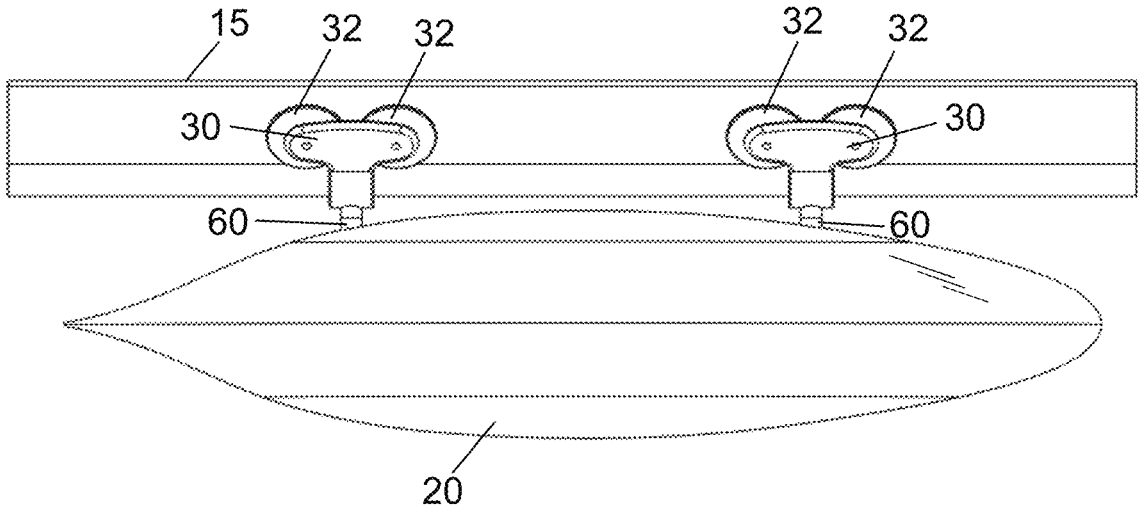
FIG. 5 depicts a right-side view of the car body suspended beneath the rail, with a similar representation of bogies and their attachment to the body as in FIG. 4.

FIG. 4 and FIG. 5 depict left and right side views respectively of the body (20) suspended beneath the rail (15). Each of the two bogies (30) are shown with two wheels (32) riding on the circular bottom flange of the rail (15). The bogies (30) are mechanically attached to the body (20) at the pivot (60).

Figure 6:
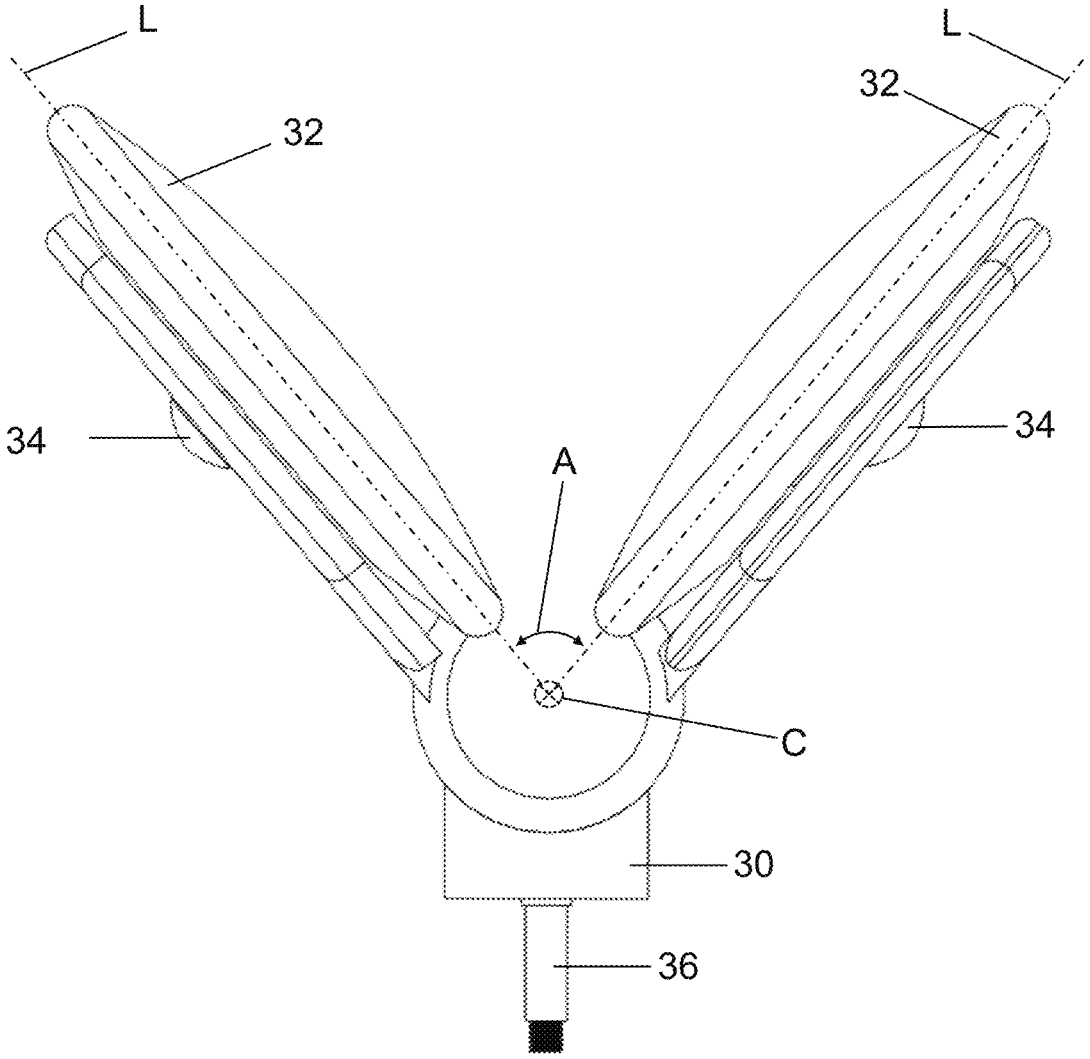
FIG. 6 is a detailed front isolated view of a bogie, its wheels, and dust cap, presenting the wheel's longitudinal axis, angle of rotation, center of rotation, and the bottom pivot axle.

FIG. 6 presents a more detailed isolated view of a bogie (30), wheels (32) and mechanical dust cap (34). The diagram shows the alignment of the wheel's longitudinal axis (L) with the center of rotation (C) and angle of rotation (A), demonstrating the unique orientation allowing the car (200) to navigate curves effectively.

Figure 7:
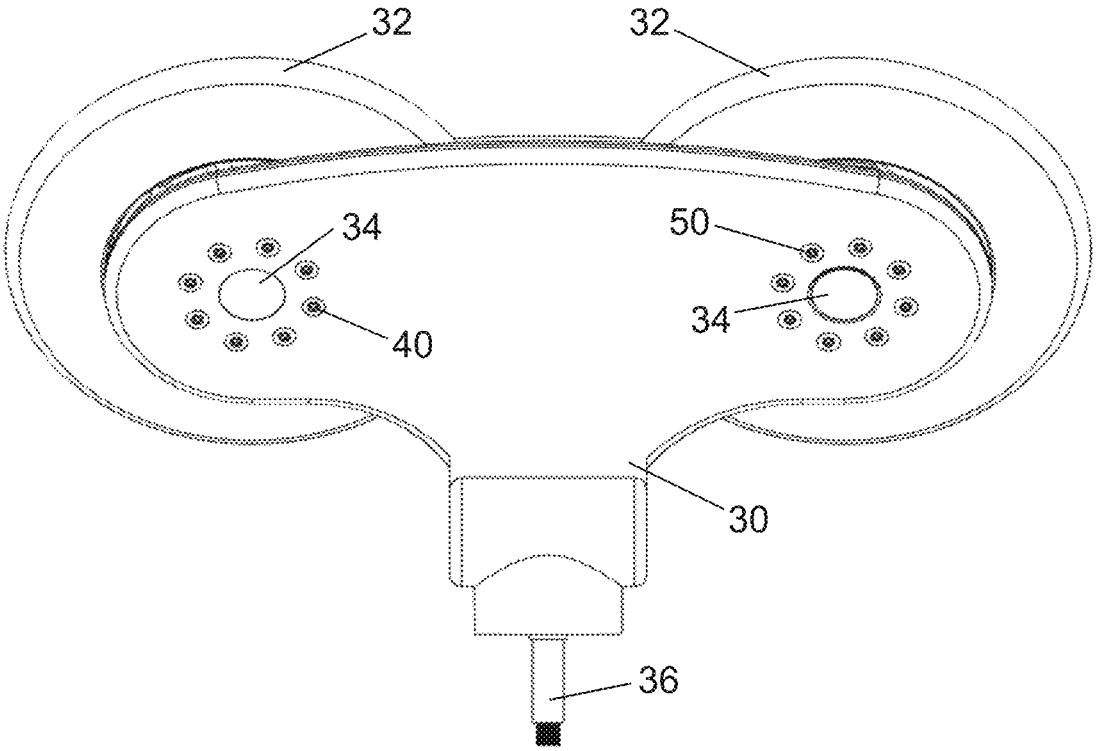
FIG. 7 is an isolated side view of a bogie and its wheels, illustrating the drive motor wheel with motor rotor bolts and the braking wheel with brake bolts, along with the depiction of the pivot axle at the bottom.
Figure 8:
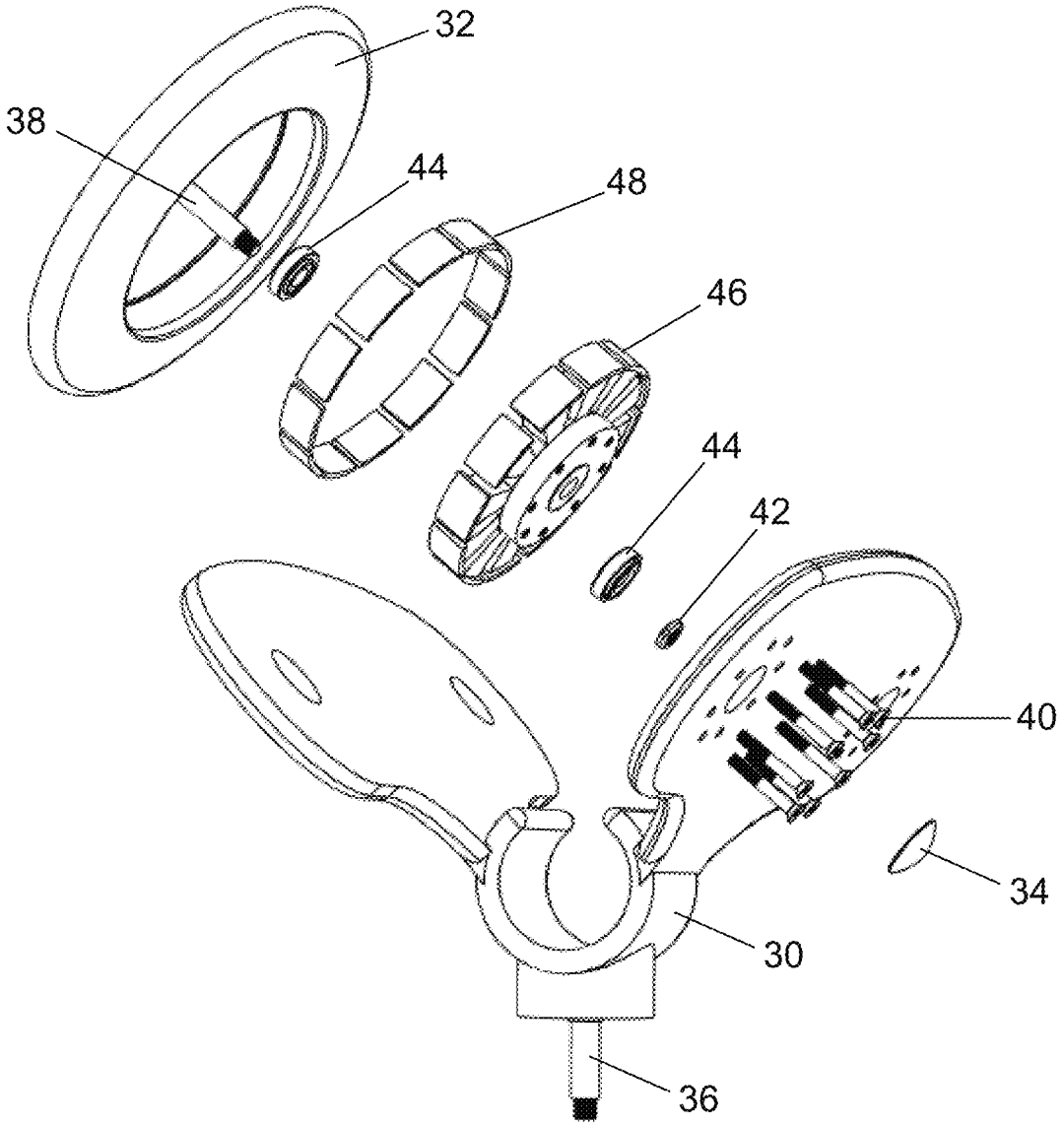
FIG. 8 offers an exploded view of a bogie and the drive wheel, demonstrating the wheel motor assembly's components, and the pivot axle at the bottom of the bogie.

FIG. 7 and FIG. 8 provide detailed side and exploded views of a bogie (30) and wheel (32). Key components of the drive wheel such as dust cap (34), stator bolts (40), stator axle nut (42), stator bearings (44), stator (46) and magnets (48) are depicted. The stator wheel axle (38) mechanically aligns all parts of the wheel motor assembly.

Figure 9:
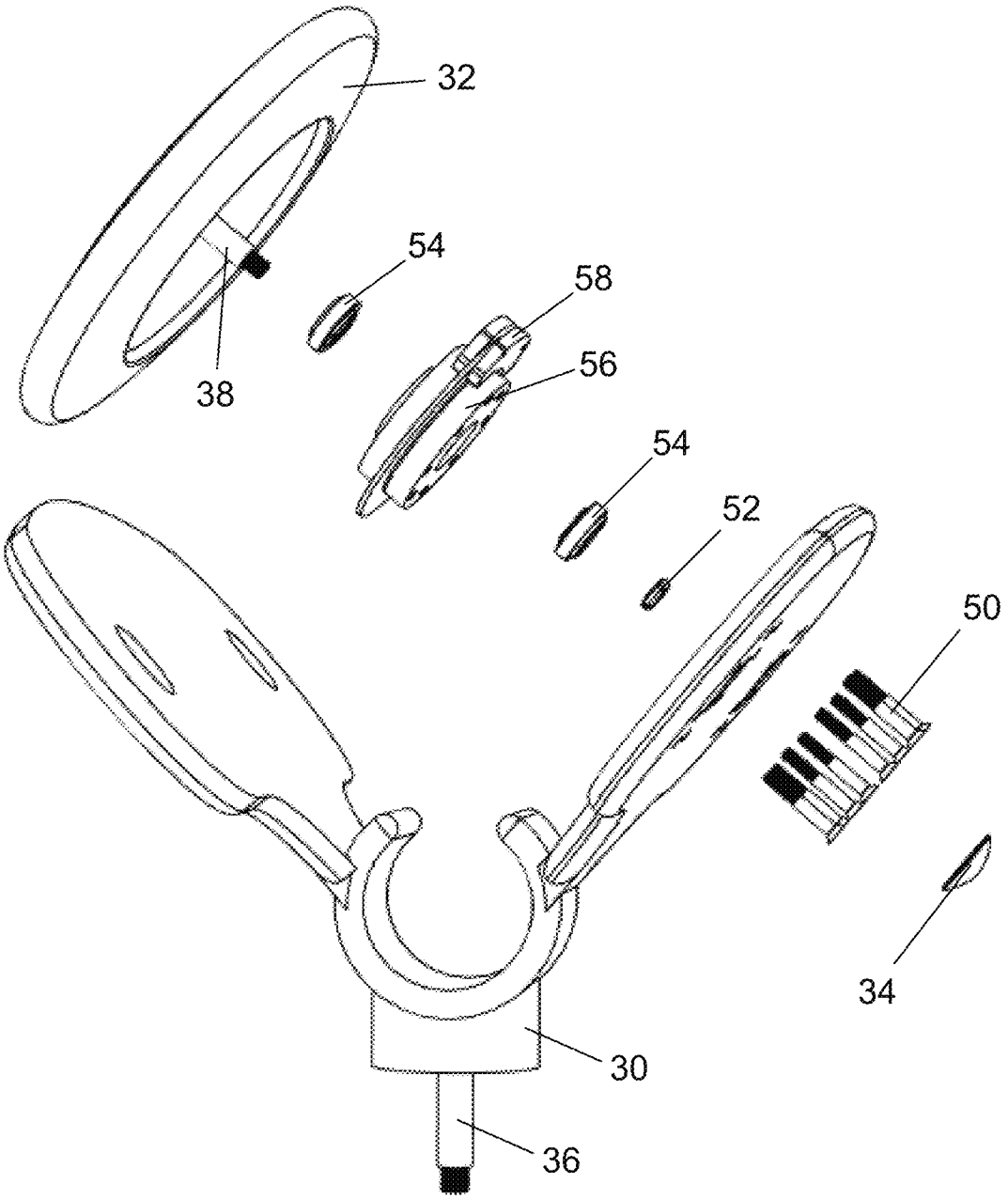
FIG. 9 provides an exploded view of a bogie and the brake wheel, detailing the brake wheel assembly's components and the pivot axle at the bogie's bottom.

FIG. 9 demonstrates an exploded view of a bogie (30) and brake wheel (32). It details the internal brake parts including the brake axle nut (52), brake rotor bearings (54), brake rotor (56), and brakes (58). The brake wheel axle (38) aligns all the components of the wheel brake assembly.

Figure 10:
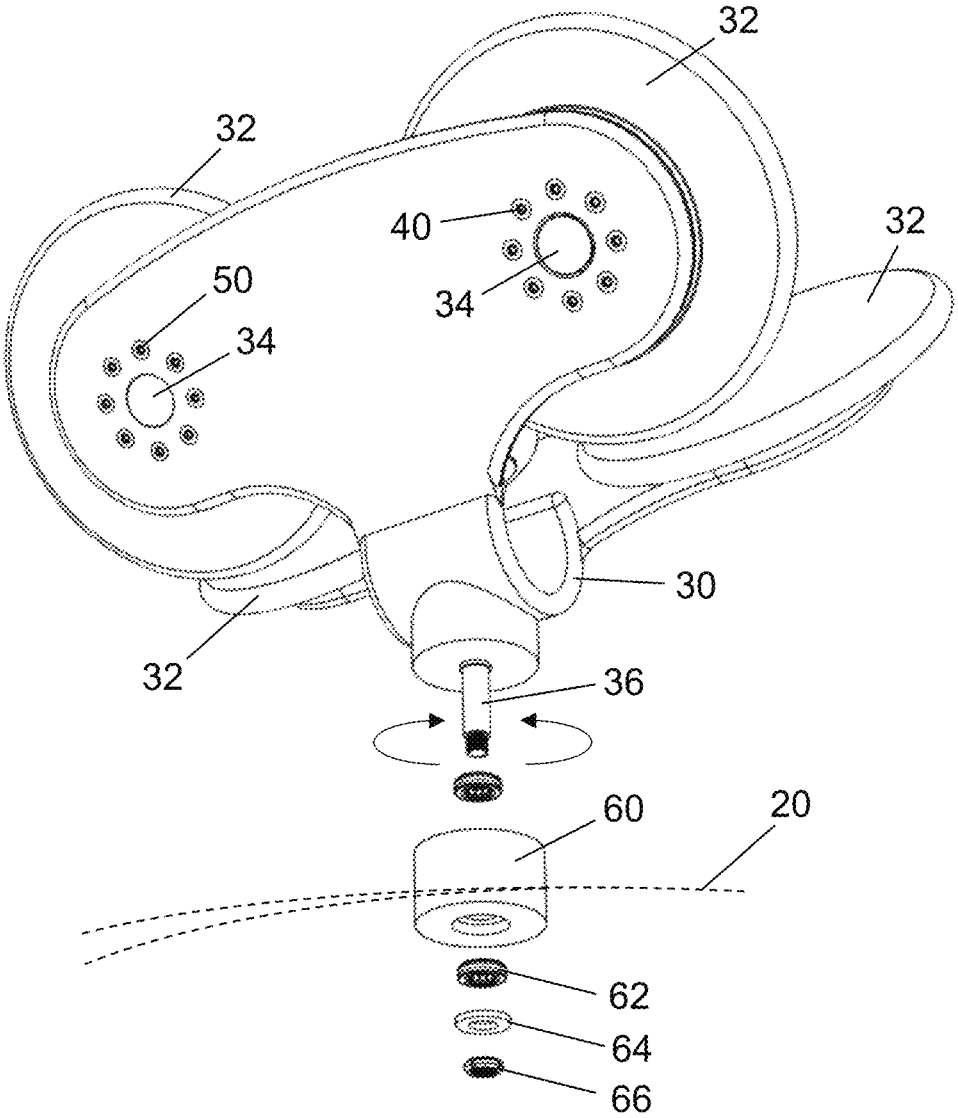
FIG. 10 reveals a perspective view of the pivot connection between the bogie and the car body, showing how the pivot axle aligns and connects various components to allow rotation of the bogies about the body.

FIG. 10 presents a perspective view of the pivot (60) connection between the bogie (30) and the car body (20). The pivot axle (36) aligns and connects the two pivot bearings (62), the pivot (60), the pivot washer (64), and the pivot nut (66), allowing the bogies to rotate about the body as the car negotiates curves.

Figure 11:
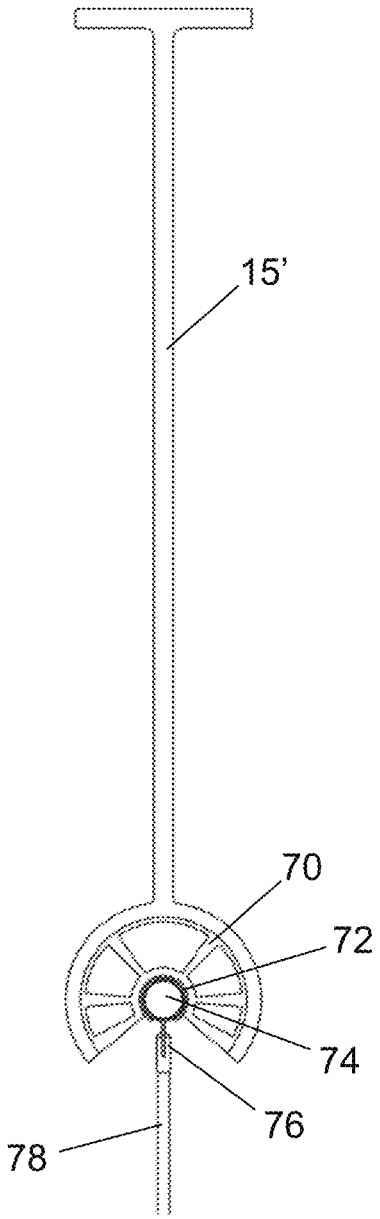
FIG. 11, pertaining to an alternative embodiment, displays a front view of an alternate rail profile with an internal electrical conductor, insulators, an electrical contact slide with magnets, and an electrical feed line.

In an alternative embodiment illustrated in FIG. 11, an open bottom flange rail profile (15') is depicted. A continuous hollow electrical conductor (72) is supported by insulators (70) within the bottom flange. An electrical contact slide (76) provides a connection for the entire system. This connection is frictionless, thanks to the vertically placed magnets (74) in the slide (76) which levitate the slide within the hollow conductor (72). An electrical feed line (78) connects the slide (76) to the car's electrical system.

Figure 12:
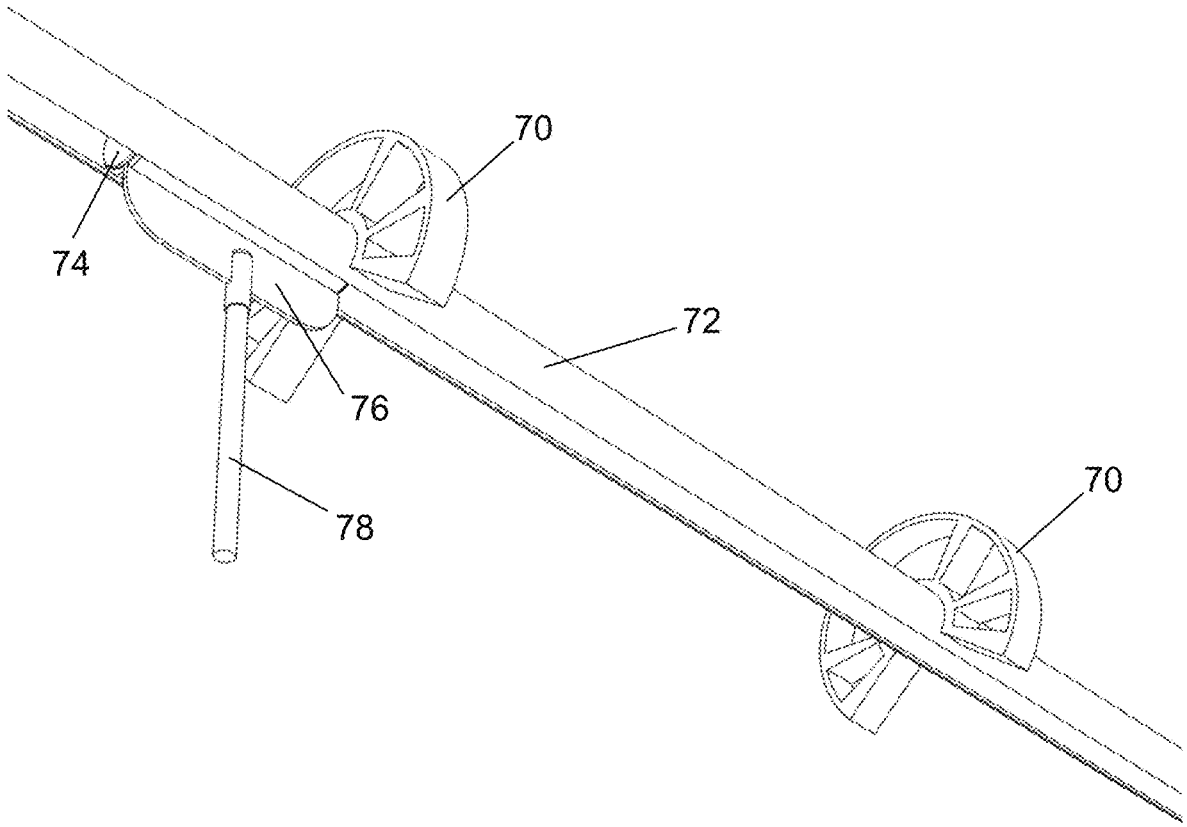
FIG. 12 is a perspective bottom view of the electrical supply system, demonstrating the placement of the contact slide within the hollow conductor and the attachment of magnets and an electrical feed line to the slide.

FIG. 12 shows a bottom perspective view of the electrical supply system, depicting a horizontal channel at the base of the hollow conductor (72). Insulators (70) are spaced at regular intervals, supporting the hollow conductor (72). Inside this, the slide (76) fits snugly, with magnets (74) and the electric feed line (78) attached.

Figure 13:
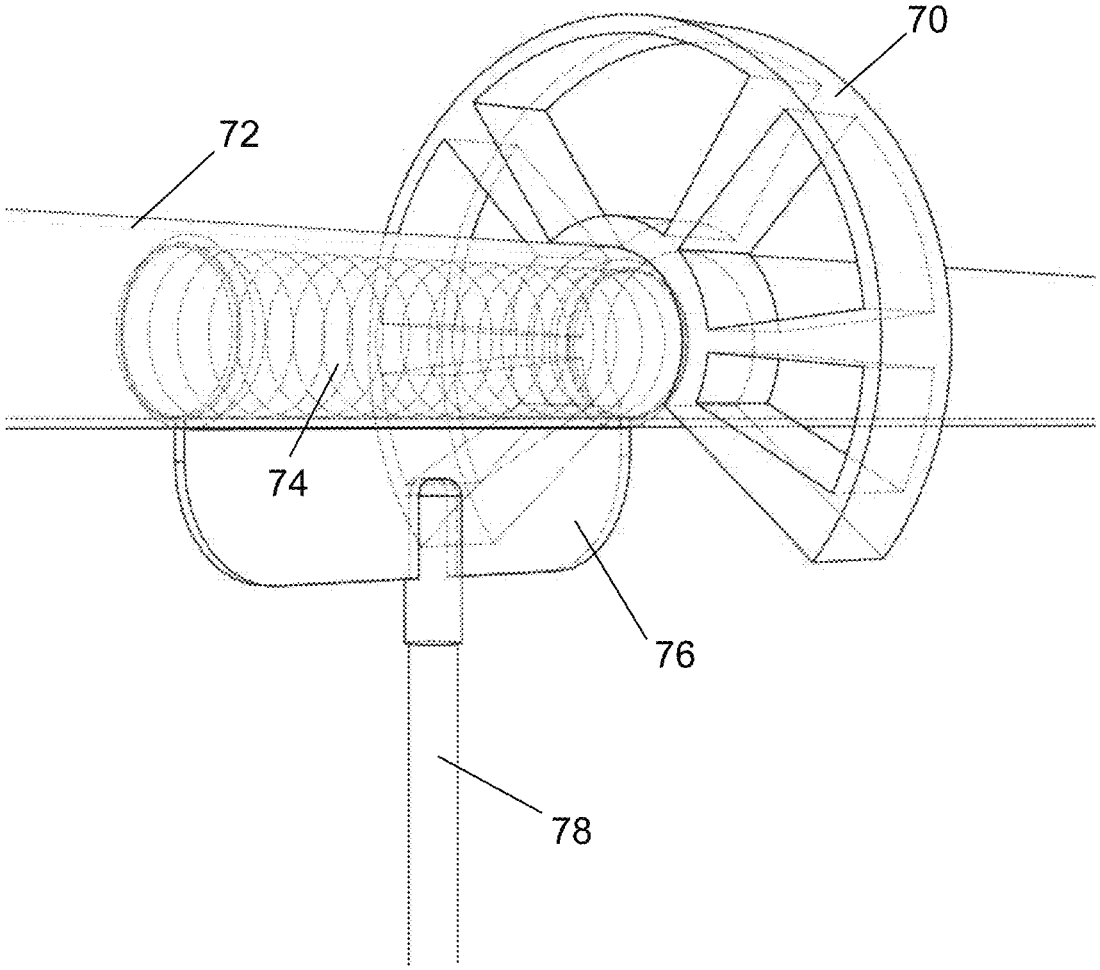
FIG. 13 is a transparent view of the hollow conductor, insulator, and the slide, showing the arrangement of magnets within the slide.

FIG. 13 offers a transparent perspective view of the hollow conductor (72), the insulator (70), and the slide (76). This view clearly demonstrates the arrangement of magnets (74) inside the slide, which allow for the frictionless operation of the electrical contact slide.

Figure 14:
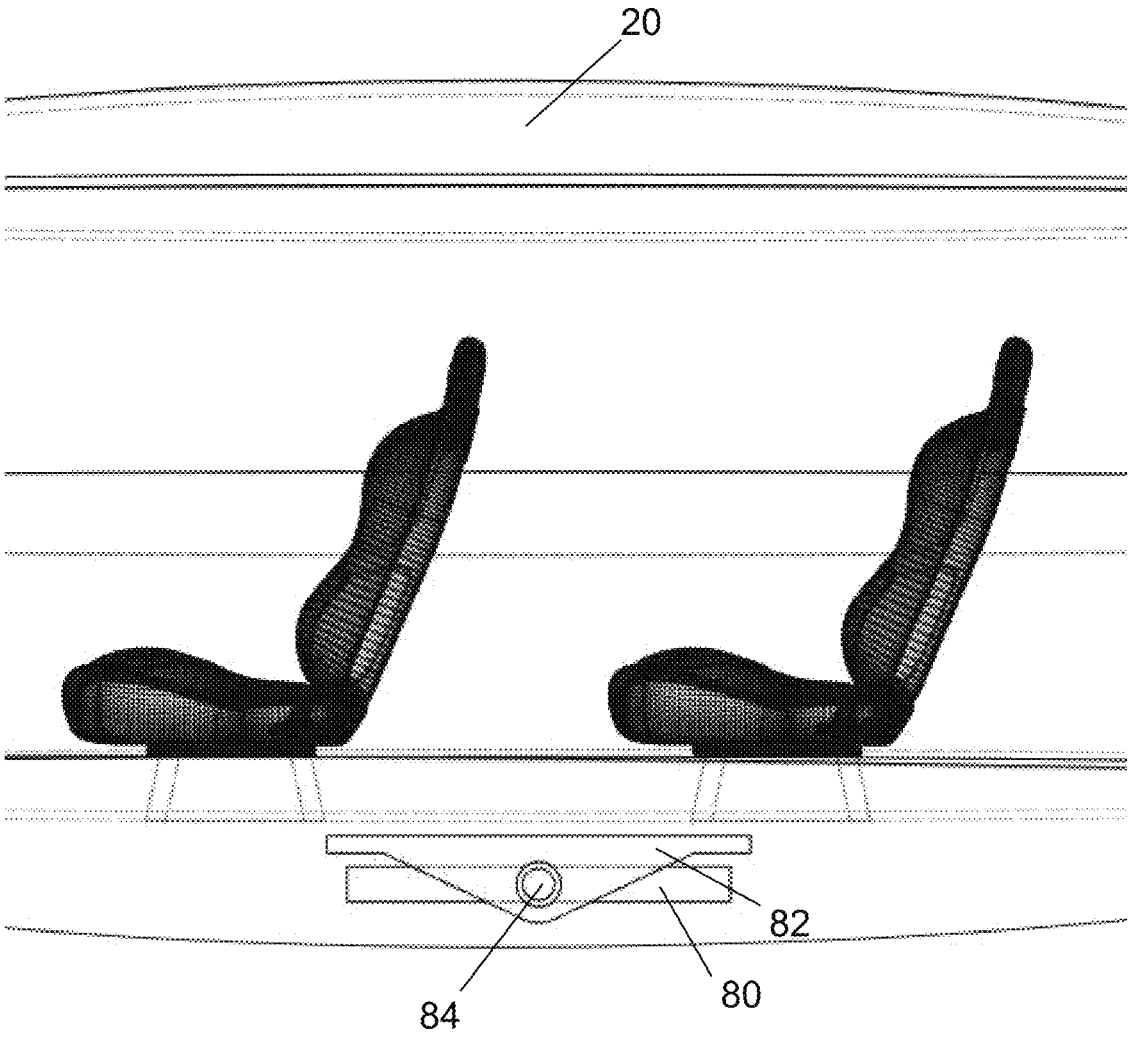
FIG. 14 is a left-side view of a lateral dampening system located at the lower portion of the car, indicating a gyroscopic flywheel mounted to a horizontal axle and connected to two frames attached to the floor frame of the car.

FIG. 14 shows a lateral dampening system mounted at the lower portion of the car (20). A gyroscopic flywheel (80) is connected to a horizontal axle (84) that is, in turn, connected to two frames (82) on either side of the flywheel. The frames (82) are rigidly attached to the floor frame of the car (20). This dampening system could alternatively be located at the front, rear, or top of the car.

The innovative system described herein may also incorporate additional features to enhance its efficiency, versatility, and passenger comfort. Among these are detachable cars for cargo transport, private cars with reduced seating capacity for increased privacy, and the potential for multiple elevated or stacked rail pairs to boost transport capacity.

Cargo cars could be designed with a quick-release mechanism, allowing for swift and efficient swapping of one car for another. This feature facilitates the smooth transition of cargo between cars, reducing downtime and increasing the overall efficiency of the transport system. Private cars may be tailored to cater to travelers desiring a more exclusive experience. These cars could feature fewer seats and added amenities, offering a luxurious and private environment. This enhancement will cater to those willing to pay more for increased comfort and privacy.

To meet demand and increase system capacity, the system could be designed to stack rail pairs vertically, using existing vertical supports. This unique feature maximizes usage of the vertical space and can substantially increase the transport capacity of the system without requiring additional land space.

The construction methods employed for the rail, support system, car, wheels, braking mechanisms, motors, and propulsion all contribute to a novel system that is significantly more cost-effective than existing systems. Estimates suggest this system could be constructed for 10 to 100 times less than current systems.

Prioritizing passenger experience, the system provides privacy, comfort, and convenience. Each car may be equipped with separate compartments for each traveler, ensuring privacy. These compartments could be outfitted with extremely comfortable chairs and ample legroom to maximize comfort. The system is designed to adhere to a specific schedule, eliminating long wait times and delays, intermediate stops, and lengthy security checks, thereby enhancing convenience.

A critical component of the system is a computer control system that manages and controls all aspects of the system. This includes acceleration and braking of the cars, climate control within the cars, emergency procedures, passenger loading and unloading, and scheduling of arrivals and departures.

The computer control system also oversees maintenance schedules, ensuring the system remains in optimal working condition. Through remote system monitoring, the computer control system can identify potential issues before they develop into serious problems, minimizing downtime and improving system reliability.

The software behind this system would be designed to handle real-time data analysis and decision making, ensuring smooth operations. It would process data from numerous sensors placed strategically throughout the system to monitor variables such as speed, temperature, passenger load, and more.

Using machine learning algorithms and predictive modeling, the software could anticipate potential issues and take pre-emptive actions to mitigate risks. For example, it could adjust the speed of the cars based on passenger load, weather conditions, or other factors. It could also modulate climate control settings in each car to ensure passenger comfort, and adjust schedules to maintain efficiency during periods of high demand or unexpected delays.

The software could also manage a digital booking system, allowing passengers to book compartments, check departure times, and receive notifications about their journey. This feature would further enhance the convenience and efficiency of the system for its users.

In the event of an emergency, the computer control system would initiate appropriate emergency procedures, such as emergency braking, passenger notification, and contact with emergency services. The system could also coordinate safe and orderly passenger loading and unloading procedures to minimize delays and ensure passenger safety.

Through these innovative features and advanced computer control, this transport system provides a revolutionary solution to the challenges of modern transportation, offering a cost-effective, efficient, and comfortable travel experience.

Network Components

A computer capable of handling the above-mentioned operations can be any suitable type of computer. A computer may be a uniprocessor or multiprocessor machine. Accordingly, a computer may include one or more processors and, thus, the aforementioned computer system may also include one or more processors. Examples of processors include sequential state machines, microprocessors, microcontrollers, graphics processing units (GPUs), central processing units (CPUs), application processors, digital signal processors (DSPs), reduced instruction set computing (RISC) processors, systems on a chip (SoC), baseband processors, field programmable gate arrays (FPGAs), programmable logic devices (PLDs), gated logic, programmable control boards (PCBs), and other suitable hardware configured to perform the various functionality described throughout this disclosure.

Additionally, the computer may include one or more memories. Accordingly, the aforementioned computer systems may include one or more memories. A memory may include a memory storage device or an addressable storage medium which may include, by way of example, random access memory (RAM), static random access memory (SRAM), dynamic random access memory (DRAM), electronically erasable programmable read-only memory (EEPROM), programmable read-only memory (PROM), erasable programmable read-only memory (EPROM), hard disks, floppy disks, laser disk players, digital video disks, compact disks, video tapes, audio tapes, magnetic recording tracks, magnetic tunnel junction (MTJ) memory, optical memory storage, quantum mechanical storage, electronic networks, and/or other devices or technologies used to store electronic content such as programs and data. In particular, the one or more memories may store computer executable instructions that, when executed by the one or more processors, cause the one or more processors to implement the procedures and techniques described herein. The one or more processors may be operably associated with the one or more memories so that the computer executable instructions can be provided to the one or more processors for execution. For example, the one or more processors may be operably associated to the one or more memories through one or more buses. Furthermore, the computer may possess or may be operably associated with input devices (e.g., a keyboard, a keypad, controller, a mouse, a microphone, a touch screen, a sensor) and output devices such as (e.g., a computer screen, printer, or a speaker).

The computer may advantageously be equipped with a network communication device such as a network interface card, a modem, or other network connection device suitable for connecting to one or more networks.

A computer may advantageously contain control logic, or program logic, or other substrate configuration representing data and instructions, which cause the computer to operate in a specific and predefined manner as, described herein. In particular, the computer programs, when executed, enable a control processor to perform and/or cause the performance of features of the present disclosure. The control logic may advantageously be implemented as one or more modules. The modules may advantageously be configured to reside on the computer memory and execute on the one or more processors. The modules include, but are not limited to, software or hardware components that perform certain tasks. Thus, a module may include, by way of example, components, such as, software components, processes, functions, subroutines, procedures, attributes, class components, task components, object-oriented software components, segments of program code, drivers, firmware, micro code, circuitry, data, and/or the like.

The control logic conventionally includes the manipulation of digital bits by the processor and the maintenance of these bits within memory storage devices resident in one or more of the memory storage devices. Such memory storage devices may impose a physical organization upon the collection of stored data bits, which are generally stored by specific electrical or magnetic storage cells.

The control logic generally performs a sequence of computer-executed steps. These steps generally require manipulations of physical quantities. Usually, although not necessarily, these quantities take the form of electrical, magnetic, or optical signals capable of being stored, transferred, combined, compared, or otherwise manipulated. It is conventional for those skilled in the art to refer to these signals as bits, values, elements, symbols, characters, text, terms, numbers, files, or the like. It should be kept in mind, however, that these and some other terms should be associated with appropriate physical quantities for computer operations, and that these terms are merely conventional labels applied to physical quantities that exist within and during operation of the computer based on designed relationships between these physical quantities and the symbolic values they represent.

It should be understood that manipulations within the computer are often referred to in terms of adding, comparing, moving, searching, or the like, which are often associated with manual operations performed by a human operator. It is to be understood that no involvement of the human operator may be necessary, or even desirable. The operations described herein are machine operations performed in conjunction with the human operator or user that interacts with the computer or computers.

It should also be understood that the programs, modules, processes, methods, and the like, described herein are but an exemplary implementation and are not related, or limited, to any particular computer, apparatus, or computer language. Rather, various types of general-purpose computing machines or devices may be used with programs constructed in accordance with some of the teachings described herein. In some embodiments, very specific computing machines, with specific functionality, may be required.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the high speed transit system have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A suspended monorail transport system comprising:

a pair of parallel, elevated rails having a bottom with a circular flange profile;

a series of monorail cars, each suspended from a pair of bogies via a rotatable pivot connection configured to permit rotation of the bogies about the car body, wherein each bogie comprises four wheels riding on the circular flange of the rail, and each wheel has a rolling axis coincident with the central axis of the circular rail flange, allowing for rolling along different areas of the circular flange while maintaining perpendicularly to the rolling axis and the central axis of the rail such that the angle of rotation of the cars and bogies with respect to the rails adjusts based on the speed, acceleration, and weight of the car, allowing the cars to negotiate curves at high speed; and wherein the wheels of each bogie are inclined at an angle such that the longitudinal wheel axis is coincident with the radial center of rotation of the circular rail flange.

2. The suspended monorail transport system of claim 1, wherein the elevated rails are supported by a series of vertical supports rigidly attached to the ground and spaced at a common interval, and which are coupled to the parallel rails by horizontal support members rigidly attached to the top of each vertical support tower.

3. The suspended monorail transport system of claim 1, wherein each bogie comprises a drive wheel and a brake wheel, each having their own unique assembly.

4. The suspended monorail transport system of claim 3, wherein the drive wheel assembly includes a stator axle nut, two stator bearings, an electric motor stator, and motor magnets permanently attached to the inside of the drive wheel, all aligned by a stator wheel axle.

5. The suspended monorail transport system of claim 4, wherein the brake wheel assembly includes a brake axle nut, two brake rotor bearings, a brake rotor, and brakes, all aligned by a brake wheel axle.

6. The suspended monorail transport system of claim 1, further comprising a computer control system to monitor and control all functions of the system.

7. The suspended monorail transport system of claim 6, wherein the functions monitored and controlled by the computer control system include: acceleration, braking, climate control, emergency procedures, passenger loading and unloading, schedule arrival and departure times, and maintenance schedules.

8. The suspended monorail transport system of claim 7, wherein the computer control system is configured to operate cars to a specific schedule with no intermediate stops.

9. The suspended monorail transport system of claim 1, wherein each car travels along one rail in a first direction and the other rail in an opposing direction.

10. The suspended monorail transport system of claim 1, wherein each car comprises separate compartments for each traveller, each compartment comprising chair and legroom.

11. The suspended monorail transport system of claim 1, wherein the rotatable pivot connection is configured with a set of bearings to ensure smooth and efficient rotation of the bogies relative to the cars.

12. The suspended monorail transport system of claim 1, wherein the cars are configured to allow for the addition or removal of car sections to adjust the capacity of the system.

13. The suspended monorail transport system of claim 1, further comprising a power supply system for providing electrical power to the cars, the power supply system including a hollow electrical conductor in the rail and an electrical contact slide that slides within the hollow electrical conductor.

14. The suspended monorail transport system of claim 13, wherein the electrical contact slide is levitated by a magnetic field to provide a frictionless connection.

15. The suspended monorail transport system of claim 1, wherein each car further comprises a gyroscopic flywheel mounted to a horizontal axle for lateral dampening.

* * * * *